United States Patent [19]

Weisgerber

[11] 3,993,302

[45] Nov. 23, 1976

[54] APPARATUS FOR REGISTERING AND FEEDING SHEETS TO A SHEET FED PRINTING PRESS

[75] Inventor: Willi Weisgerber, Johannisberg, Rheingau, Germany

[73] Assignee: Miller Printing Machinery Co,, Pittsburgh, Pa.

[22] Filed: Apr. 18, 1975

[21] Appl. No.: 569,468

Related U.S. Application Data

[63] Continuation of Ser. No. 416,285, Nov. 15, 1973, abandoned, which is a continuation-in-part of Ser. No. 361,521, May 18, 1973, abandoned, which is a continuation of Ser. No. 165,521, July 23, 1971, abandoned.

[30] Foreign Application Priority Data

July 30, 1970 Germany ..... 2037806

[52] U.S. Cl. ..... 271/245; 74/82; 271/254; 271/255; 271/272

[51] Int. Cl.[2] ..... B65H 9/06; B65H 5/06

[58] Field of Search ..... 271/245, 246, 247, 253, 271/254, 255, 244, 236, 237, 272; 74/82, 89.2

[56] References Cited

UNITED STATES PATENTS

| | | | |
|---|---|---|---|
| 562,124 | 6/1896 | Doolittle | 74/82 |
| 1,159,011 | 11/1915 | Garlick | 271/253 |
| 2,211,765 | 8/1940 | Davidson | 271/246 |
| 2,708,405 | 5/1955 | Gegenheimer | 271/261 X |
| 2,810,295 | 10/1957 | Voss | 74/82 |
| 3,561,771 | 2/1971 | Koch | 271/253 X |

FOREIGN PATENTS OR APPLICATIONS

| | | | |
|---|---|---|---|
| 609,703 | 9/1960 | Italy | 74/89.2 |
| 217,456 | 10/1941 | Switzerland | 74/82 |
| 681,838 | 10/1952 | United Kingdom | 74/82 |

*Primary Examiner*—Evon C. Blunk
*Assistant Examiner*—Bruce H. Stoner, Jr.
*Attorney, Agent, or Firm*—Stanley J. Price, Jr.

[57] ABSTRACT

Sheets are fed down an inclined feedboard to a transfer cylinder of a printing press. Adjacent the delivery end of the feedboard there are a plurality of pairs of feed rolls to accelerate the sheets toward the transfer cylinder and a plurality of front guide members to preregister the front edge of the sheet. The pairs of feed rolls each include a driven roll that oscillates through an arc in timed relation with the transfer cylinder. The feed roll drive mechanism includes pairs of flexible members wrapped in opposite directions around and secured to the feed roll drive shaft on which the driven feed rolls are mounted. In one embodiment one of the flexible members is connected to a lever mechanism and the other flexible member is connected to the press housing through a spring member. In another embodiment both flexible members are connected to the lever member with a spring member on the lever member maintaining a tension on both flexible members. The lever member is pivotally connected at one end to the press frame or bearing housing of the transfer cylinder and has a cam follower roller between the pivot connection and the flexible members. A cam member rotatable with the transfer cylinder pivots the lever in one direction to rotate the driven feed rolls through a preselected arc. A spring member urges the cam follower mounted on the lever against the cam member. The pivot connection for the lever includes an eccentric member that moves the pivot axis of the lever and changes the degree of buckling of the sheet against the front stop members on the transfer cylinder as the sheet is conveyed by the driven feed rolls.

15 Claims, 9 Drawing Figures

210
212
214
216
218
220
222
224
226
228
230
232
234
236
238
240
242
244
246
248
250
252
254
256
258
260
262
264
266
268
270
272
274
276
278
280
282
284
286
288
290
292
294
296
298
300
302
304
A
VIII
IX

APPARATUS FOR REGISTERING AND FEEDING SHEETS TO A SHEET FED PRINTING PRESS

CROSS REFERENCE TO RELATED APPLICATIONS

This application is a continuation of co-pending application, Ser. No. 416,285, filed Nov. 15, 1973, entitled "Apparatus For Registering And Feeding Sheets To A Sheet Fed Press", now abandoned, which, in turn, is a continuation-in-part of application, Ser. No. 361,521 filed May 18, 1973 now abandoned. The latter application is a continuation of application, Ser. No. 165,521, filed July 23, 1971, now abandoned.

BACKGROUND OF THE INVENTION

1. Field of the Invention

This invention relates to apparatus for feeding sheets to a sheet fed printing press and more particularly to apparatus for feeding sheets to a sheet fed printing press including means to adjust the buckling of the sheet.

2. Description of the Prior Art

It is known to provide pairs of feed rolls mounted adjacent the delivery end of a feedboard and adjacent to a transfer cylinder. It is further known, as illustrated in U.S. Pat. No. 2,708,405, to drive the feed rolls in timed relation with the transfer cylinder and the other portions of the printing press. The sheets are fed along an inclined feedboard and move into butting relation with front stops or guides to preregister the front or leading edge of the sheet. The sheets are thereafter moved transversely against side guides to register the side edge of the sheets on the feedboard. After the front and side register of the sheet, the sheet is engaged by the driven feed rolls and conveyed at a velocity higher than the circumferential or peripheral velocity of the transfer cylinder into butting relation with a register bar on a rotating cylinder. The higher speed causes the individual sheets to buckle adjacent their front edge as the sheet abuts the front register bar to assure proper register of the sheet prior to the sheet being engaged by the grippers on the transfer cylinder.

As is illustrated in U.S. Pat. No. 2,706,405, the apparatus with which the driven feed rolls are oscillated includes gear segments and a plurality of gear wheels. A high degree of accuracy or precision is required in the forming of the gear segments and the gear wheels to minimize loss of register due to the clearance between the gear teeth. Also because the motion imparted to the feed rolls by the plurality of gears and gear segments is an oscillatory motion, the inertia of the gears during reversal results in gear backlash and loss of precise register. There is a need for a feeder apparatus that eliminates the inaccuracies caused in sheet register by the gears and gear segments that drive the feed rolls.

It is also known to adjust the amount of buckling of the front portion of the sheet. Adjustment in sheet buckling must be made when sheets of different thicknesses, as for example relatively thin or tissue type sheets and relatively thick or paperboard sheets, are fed into the press. The degree of buckling should be at a minimum with relatively thick sheets and, to assure proper register, should be increased with the relatively thin sheets. Mechanical adjusting devices are known to control the amount of buckling of the sheets. Adjustment by the known adjusting devices can only be accomplished when the press is stopped. There is a need for an adjusting apparatus that permits adjusting the degree of sheet buckling while the press is in operation to provide a more precise front register on the rotating cylinder.

SUMMARY OF THE INVENTION

This invention relates to apparatus for feeding sheets to a sheet fed printing press that includes a feedboard with a rotatable cylinder mounted adjacent to the delivery end of the feedboard. A feed roll drive shaft extends transversely across the feedboard adjacent to the feedboard delivery end. Driven feed rolls are secured to the feed roll drive shaft for rotation therewith. A cam member is provided that rotates in timed relation with the rotatable cylinder. Flexible means are connected to the feed roll drive shaft and to a lever member. The lever member is movable by the cam member to oscillate the feed roll drive shaft and the driven feed rolls through a preselected angular displacement in timed relation with the rotatable cylinder.

The flexible means includes a first flexible member that has an end portion wrapped in a first direction around the feed roll drive shaft and the other end portion movable toward and away from the feed roll drive shaft by the cam member. The flexible member parts rotation to the feed roll drive shaft in one direction. A second flexible member, which could be a portion of the first flexible member, has an end portion wrapped around the feed roll drive shaft in a direction opposite to the direction of the first flexible member. A resilient means is connected to the second flexible member and maintains the second flexible member under tension to urge the feed roll drive shaft to rotate in a direction opposite to that imparted by the first flexible member. In one embodiment the resilient means is connected to the press and in another embodiment the resilient means is connected to the lever member. The cam actuated flexible member is connected to the lever, which in turn is mounted on an eccentric member. Means are provided to rotate the eccentric member and adjust the pivot axis of the lever and the degree of buckling of the sheet. In one embodiment rotation of the eccentric member rotates the feed roll drive shaft and changes the relative position of the front guide members. In another embodiment rotation of the eccentric member moves both the lever and the cam follower longitudinally to change the timing of the driven feed rolls and thus change the starting time for conveying the sheets to the transfer cylinder. This adjustment by both of the embodiments can take place while the press is in operation.

Accordingly, the principal object of this invention is to provide apparatus for feeding sheets to a sheet fed printing press that does not utilize gear segments to oscillate the feed rolls.

Another object of this invention is to provide apparatus for adjusting the degree of buckling in the sheets fed to a rotating cylinder of a printing press while the printing press is in operation.

These and other objects and advantages of this invention will be more completely disclosed and described in the following specification, the accompanying drawings and the appended claims.

DESCRIPTION OF THE PREFERRED EMBODIMENTS

Figure 1:
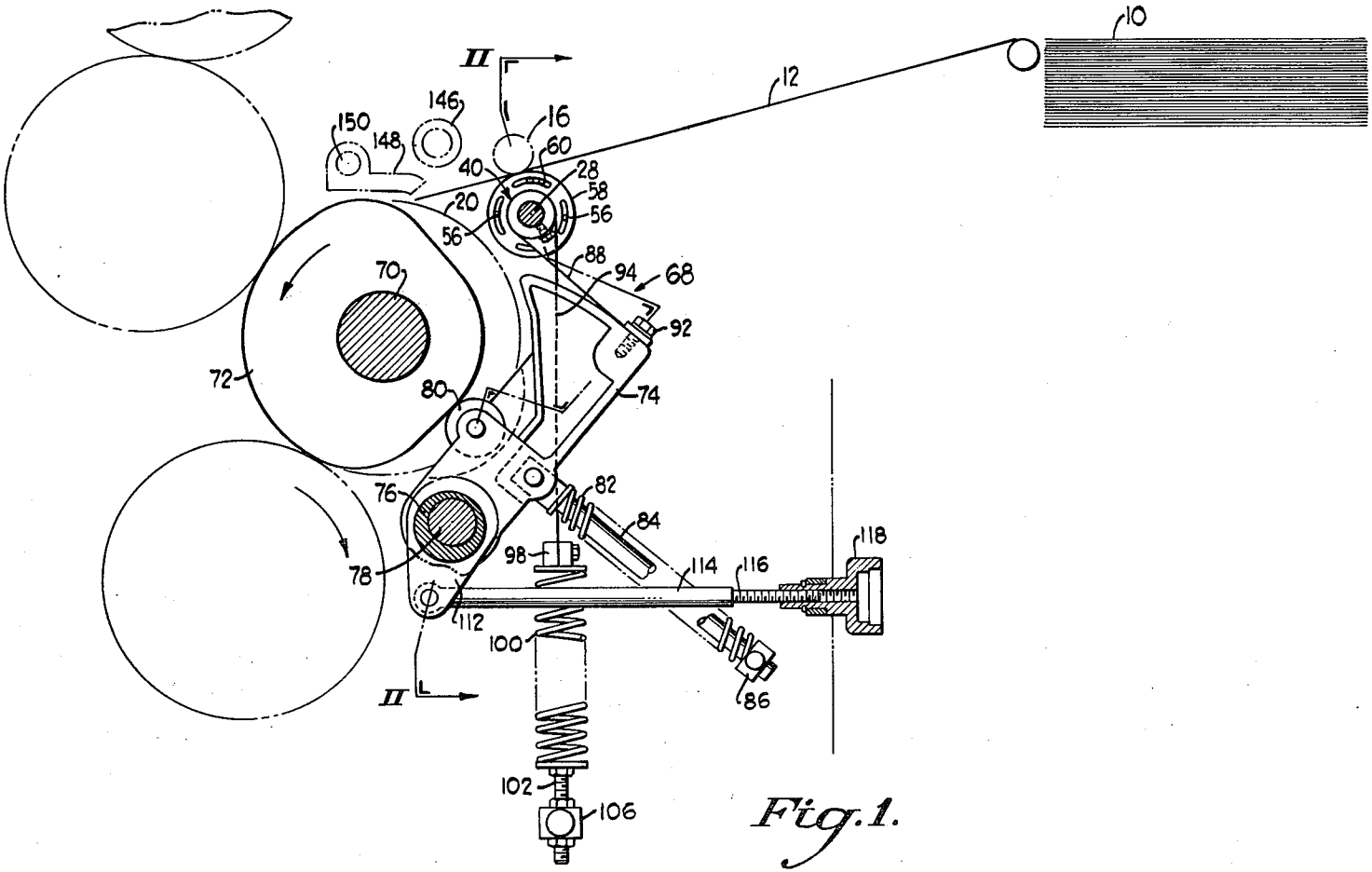
FIG. 1 is a schematic view in side elevation of a sheet feeding device illustrating the improved apparatus for feeding the sheets to a rotating cylinder.

U.S. Pat. No. 2,708,405 discloses a sheet fed printing press and apparatus for feeding sheets from a stack to a transfer cylinder of the printing press. The apparatus illustrated and described in this patent is incorporated herein by reference.

As discussed in the above patent and schematically illustrated in the embodiment illustrated in FIGS. 1-6, sheets of paper are fed from a stack 10 onto an inclined feedboard 12 and are conveyed to a front guide or front stop generally designated by the numeral 14 located adjacent the delivery end of the feedboard 12. The front guide 14 is arranged to preregister or align the front edge of the sheet before it is conveyed to the press. Pairs of feed rolls 16 and 18 (FIG. 3) are arranged to engage the sheet and convey the sheet against a register bar mounted on a rotatable cylinder 20 which may be an impression cylinder of the press or a transfer or pick-up cylinder. Grippers 22 on cylinder 20 engage the front edge of the sheet after the front edge abuts the register bar. The rotation of the cylinder 20 thereafter transfers the sheet to the other cylinders of the printing press. When the sheet has moved into abutting relation with the front stops 14 on the feedboard and is preregistered, it is thereafter moved laterally by a suitable side register apparatus against side guides. In this manner the sheets thereafter fed by means of the pairs of feed rolls 16 and 18 to the rotating cylinder 20 is in both side and front register.

Figure 2:
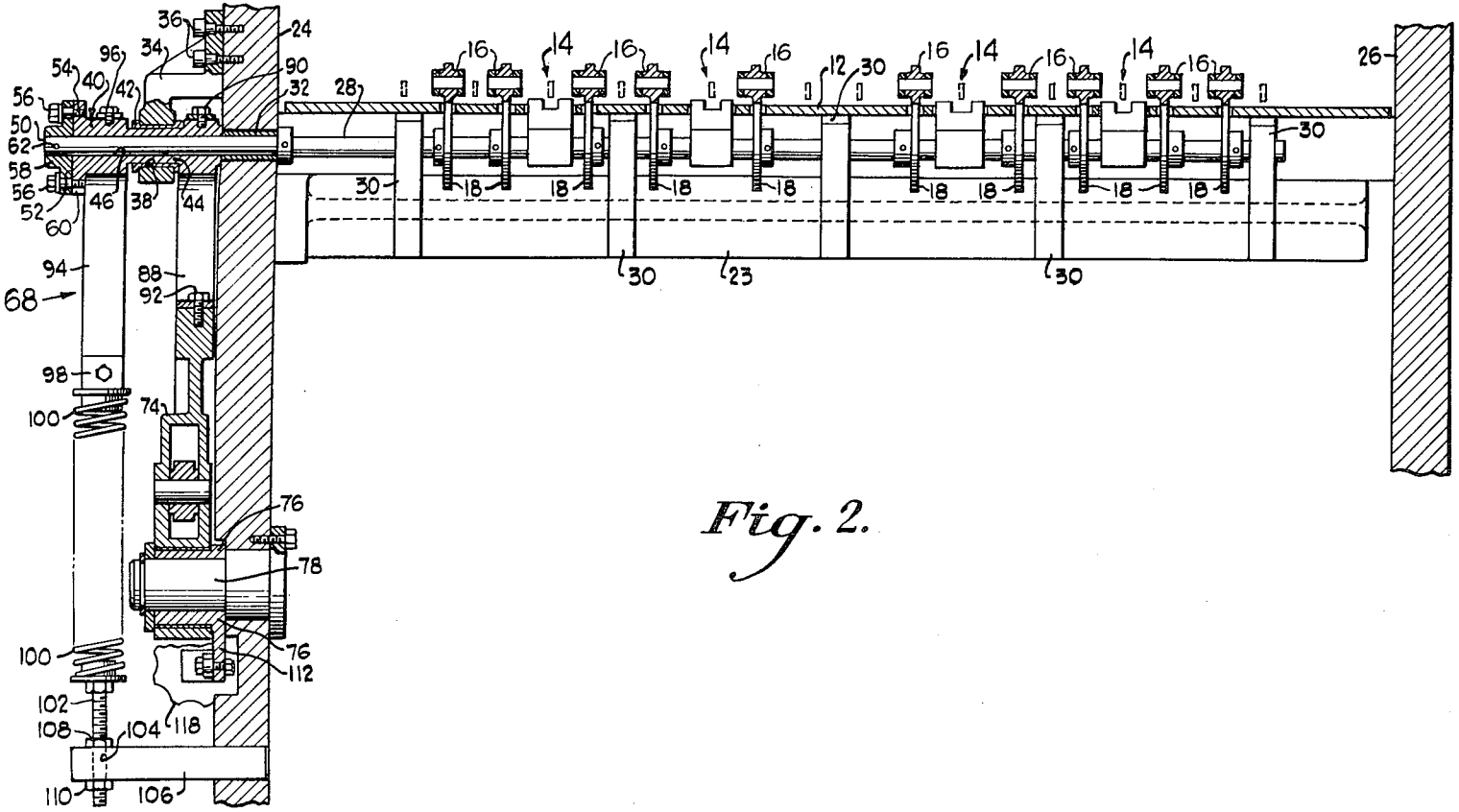
FIG. 2 is a view in section and in end elevation taken along the line II—II of FIG. 1 illustrating the actuating means for the feed rolls and the front guides on the feedboard.

Now referring in greater detail to the drawings and particularly to FIGS. 1 and 2, the feedboard 12 is suitably supported on upwardly extending support arms 30 of a transverse support member 23 that is secured to the side frames 24 and 26. The lower feed rolls 18 are nonrotatably secured to a roll actuator shaft 28 that extends transversely below the feedboard 12 with the rolls 18 extending up through openings in the feedboard so that the outer periphery of the feed rolls 18 is slightly above the upper surface of the feedboard 12. The shaft 28 is rotatably supported at one end in a support arm 30 of the transverse support member 23 and is journaled in a bearing 32 in the frame member 24. The shaft 28 is also supported by a bracket member 34 secured to the frame 24 by bolts 36. The bracket 34 has a bore 38 therethrough in which a band connecting member generally designated by the numeral 40 is rotatably supported.

The intermediate portion 44 of the band connecting member 40 is journaled in a bearing 42 positioned in bore 38 to permit rotation of the band connecting member 40 in bracket 34. The band connecting member 40 has an axial bore 46 therethrough and the roll actuator shaft 28 extends through the bore 46 with the end portion 50 extending beyond the outer face 52 of band connecting member 40. The band connecting member 40 has a plurality of threaded apertures 54 therein to receive bolts 56.

A hub member 58 has a plurality of arcuate slots 60 therein (FIGS. 1 and 2) and is positioned in abutting relation with the outer face 52 of band connecting member 40. The bolts 56 extend through the slots 60 and are threadedly secured in bolt apertures 54. The hub member 58 is nonrotatably secured to the end 50 of the roll actuator shaft 28 by means of a pin 62. With this arrangement the front guides or stops generally designated by the numeral 14 that are nonrotatably secured to the roll actuator shaft 28 may be adjusted arcuately toward and away from the transfer cylinder 20 by loosening bolts 56 and rotating the shaft 28 and hub member 58 through a preselected angular distance relative to the band connecting member 40.

As illustrated in FIGS. 1 and 2, apparatus is provided to drive or oscillate the feed rolls 18 toward and away from the transfer cylinder 20 and is generally designated by the numeral 68. The feed rolls 18 oscillate in timed relation to the transfer cylinder 20 and are driven by the transfer cylinder 20 through the actuator apparatus 68. The cylinder 20 has a shaft 70 that rotates with the cylinder 20. A cam member 72 is mounted on the shaft 70 for rotation therewith in timed relation with the cylinder 20 and is arranged to actuate the feed roll drive apparatus 68.

A lever 74 is rotatably supported on an eccentric bushing 76 which is mounted on a shaft 78 secured to the frame 24 (FIG. 2). The lever 74 has a roller 80 rotatably mounted thereon and arranged to abut the peripheral surface of cam member 72. The roller 80 is urged into abutting relation with the surface of cam member 72 by means of spring 82 mounted on a guide rod 84. The end 86 of guide rod 84 is suitably secured to the frame member 24 (not shown).

A flexible member 88, which will also be referred to as a flexible band, has an end portion extending around the outer periphery of the flexible band connecting member 40 and is secured thereto by means of bolt 90. The other end of the flexible member 88 is secured to the lever 74 by bolt 92. The flexible member 88 is wrapped around at least a portion of the periphery of the band connecting member 40 so that movement of the lever 74 in a clockwise direction rotates the shaft 28 and the drive rolls 18 in a counterclockwise direction as viewed in FIGS. 1 and 3.

A second flexible member 94 is secured at one end to the band connecting member 40 by bolts 96 and is wound about the periphery of the band connecting member 40 in a direction opposite to the flexible member 88. The flexible member 94 is connected at the other end by means of a clamp 98 to a spring 100. The spring 100 is, in turn, connected to a threaded shaft 102 that extends through a bore 104 in bracket 106 extending outwardly from the frame 24. The shaft 102 has adjusting nuts 108 and 110 that are arranged to adjust the tension in spring 100. The flexible member 94 urges the feed rolls 18 and shaft 28 in a clockwise direction opposite to the rotation imparted to the feed rolls 18 by the flexible member 88. The flexible members or bands 88 and 94 are preferably steel bands capable of flexing without wear or set to the bands. It should be understood, however, other materials could be employed such as lengths of link chain, wire or the like. Although the flexible members or bands 88 and 94 are illustrated as separate bands it should be understood that a single flexible band could be secured intermediate its end portions to the feed roll shaft and the end portions secured to the lever 74 and spring 100 as previously described. As the cam 72 rotates in timed relation with the cylinder 20 a portion of the cam 72 pivots the lever 74 about the eccentric bushing 76 and rotates the roll actuator shaft 28 and feed rolls 18 in a sheet feeding direction by means of the flexible members 88 and 94. The spring 100 and flexible member 94 rotate the shaft 28 and feed rolls 18 in an opposite clockwise direction as the cam roller is urged against another portion of the cam surfce by spring 82.

As illustrated in FIGS. 1 and 2, the eccentric bushing 76 mounted on shaft 78 has an arm 112 extending radially therefrom. The arm 112 is connected to a shaft 114 that has a threaded bore therein. A threaded rod 116 is threadedly secured in the threaded bore of shaft 114. An adjusting hand wheel 118 is connected to the threaded rod 116 and is rotatably supported on a portion of the frame to permit rotation of hand wheel 118 without axial movement thereof. Rotation of hand wheel 118 rotates the rod 116 and through the threaded connection with shaft 114 extends or retracts shaft 114 to thereby rotate the arm 112 and the eccentric bushing 76 about the shaft 78. The rotation of the eccentric bushing 76 changes the pivotal axis of the lever 74 to thus, through flexible member 88, slightly rotate the shaft 28 and the front guides 14 nonrotatably mounted thereon. The changing of the pivot point or axis of lever 74 thus causes the front guides 14 to be rotated through a predetermined angular distance toward and away from the transfer cylinder 20. The effective length of the flexible band 88 is changed and the angular displacement of the lever by the cam 72 is also changed. This arrangement permits adjusting the amount of buckling imparted to the sheet while the printing machine is running to thereby obtain precise register of the sheet. The dial on the hand wheel 118 shown in FIG. 6 may be employed to indicate the amount of adjustment made and the amount of adjustment required for a particular grade or thickness of paper can be determined. This position of the dial can be quickly set when the particular grade or thickness of paper is used and fine or precise further adjustmment can be made while the press is running.

Figure 4:
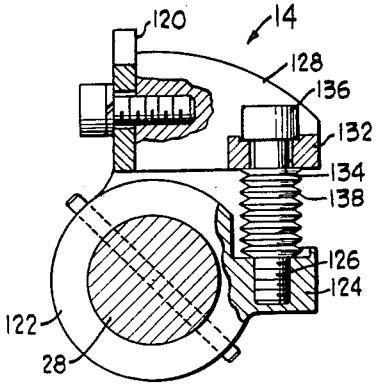
FIG. 4 is a view in section and side elevation of one of the front guides mounted on the feed roller actuator shaft.
Figure 5:
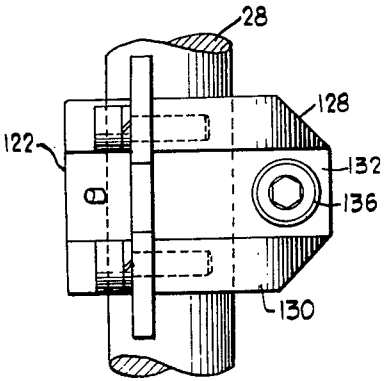
FIG. 5 is a top plan view of the front guide illustrated in FIG. 4.

The front guides generally designated by the numeral 14 are shown in FIG. 2 and illustrated in detail in FIGS. 4 and 5. The front guides have a paper abutting portion 120 against which the front edge of the sheet is urged to preregister the sheets. A separate hub member 122 is nonrotatably secured to the roll actuator shaft 28 and has an arm member 124 extending radially therefrom with a threaded bore 126 therein. The front guide paper butting portion 120 has a yoke portion rotatably mounted on the shaft 28 with rearwardly extending arms 128 and 130. A transverse member 132 connects the arms 128 and 130 and has a central aperture 134 and is threadedly secured in the threaded bore 126 of arm 124. A resilient spring member 138 abuts the transverse member 132 and the arm 134. With this arrangement it is possible to individually adjust each of the front guides 14 on the shaft 28 to align the front guides 120 along a straight line or to adjust the guides into a concave or convex face as is required by the particular configuration of the paper sheets. It is also possible to move certain of the front guides 120 where required into an inoperative position out of the paper line. The resilient force exerted by the spring 138 does not require counter adjustment and thereby accelerates the adjustment of the front guides 14.

Figure 3:
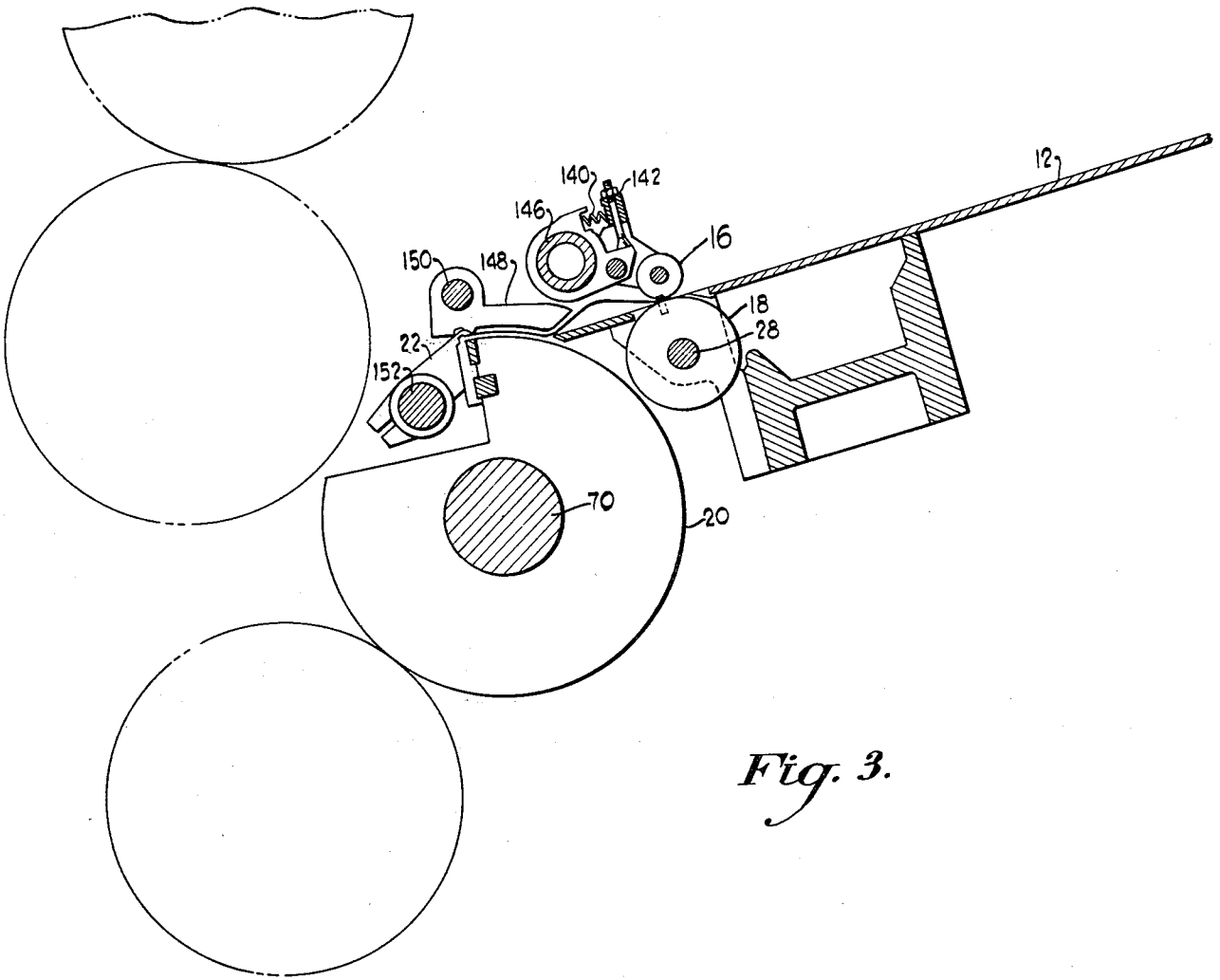
FIG. 3 is a view in side elevation similar to FIG. 1 illustrating the manner is which the sheet is buckled as it is engaged by the grippers on the rotating cylinder.
Figure 6:
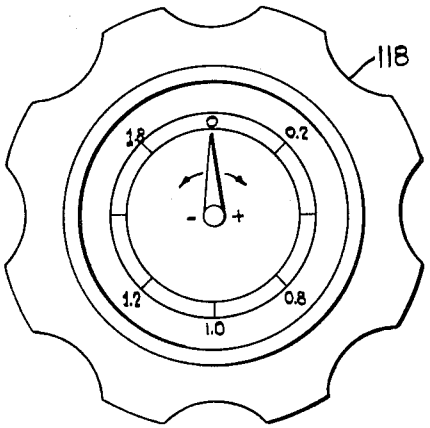
FIG. 6 is a view in elevation of the actuator dial for adjusting the degree of buckling of the sheet.

In FIG. 3 there is illustrated schematically apparatus for moving the upper roll 16 toward and away from the roller driven roll 18. The upper rolls 16 are connected by spring 140 with adjustable stops 142 to an upper roller shaft 146. The upper roller shaft 146 is parallel to the roll actuator shaft 28. A conventional paper guide 146 is provided and is pivotally supported on shaft 150. The grippers 22 on cylinder 20 are mounted on a gripper shaft 152. Rotation of gripper shaft 152 opens and closes the grippers to engage and release the front edge of the sheets that are conveyed into abutting relation with a front register bar on the transfer roller 20.

With the above described apparatus it is now possible to adjust the amount of buckle in the sheet while the press is in operation and to make accurate and precise adjustments while the press is running. The cam and lever arrangement and the flexible bands connecting the lever to the feed roll actuator shaft provides an accurate precise drive for the feed rolls without the back lash and gear noises present in known devices employing gear segments and a plurality of connecting gears.The front guides or stops mounted on the roll actuator shaft may be easily and quickly adjusted for sheets having different front edge configurations.

Figures 7, 8, 9:
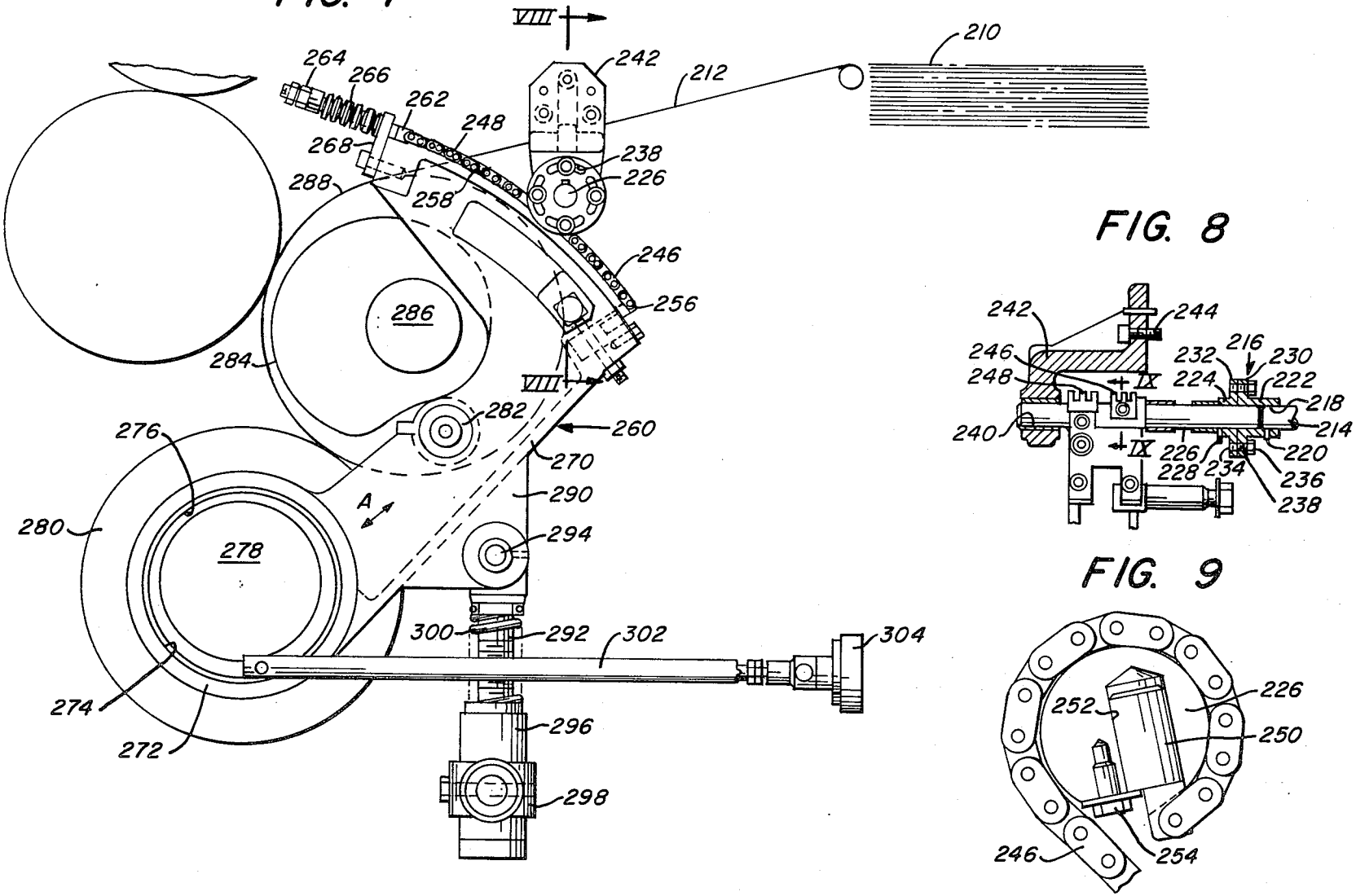
FIG. 7 is a schematic view in side elevation of another embodiment of a sheet feeding device illustrating both of the flexible members connected to the lever member.
FIG. 8 is a view in section taken along the line VIII—VIII in FIG. 7 illustrating the apparatus for securing the flexible members to the feed roll drive shaft.
FIG. 9 is a view in section taken along the line IX—IX in FIG. 8 illustrating the manner in which one of the flexible chain members is connected to the feed roll drive shaft.

In FIGS. 7, 8 and 9 another embodiment is illustrated in which sheets of paper are fed from a stack 210 onto an inclined feedboard 212 that is diagrammatically illustrated in FIG. 7. The sheets are conveyed to a front guide or stop located adjacent the delivery end of the feedboard. The front guide is arranged to preregister or align the front edge of the sheet before it is conveyed to the press. Suitable feed rolls are provided, such as previously described, to engage the sheet and convey the sheet against a register bar mounted on a rotatable cylinder which may be either an impression cylinder of the press or a transfer or pickup cylinder. Grippers on the cylinder engage the front edge of the sheet after the front edge of the sheet abuts the register bar. Rotation of the cylinder thereafter transfers the sheet to the other cylinders of the printing press. When the sheet has been moved into abutting relation with the front stops on the feedboard and is preregistered it is thereafter moved laterally by a suitable side register apparatus against side guides. In this manner the sheet is thereafter by means of the pairs of feed rolls fed to the rotating cylinder in both front and side register.

The lower feed rolls are non-rotatably secured to a feed roll shaft 214 (FIG. 8) that extends transversely below the feedboard 212 with the feed rolls extending upwardly through openings in the feedboard so that the outer periphery of the feed rolls is slightly above the upper surface of the feedboard 212. The roll actuator shaft 214 is suitable supported, as previously described, with one end portion positioned in a coupling member generally designated by the numeral 216. The coupling member 216 has a cylindrical bore 218 with a set screw 220 extending therethrough. The roll actuator shaft 214 is positioned in the cylindrical bore 218 of coupling member 216 and is secured therein by set screw 220.

The coupling member 216 has a first portion 222 and a second portion 224. A connecting shaft 226 extends through the cylindrical bore 218 in coupling 216 and is secured by means of a set screw 228 to the coupling half 224. The coupling halves 222 and 224 have radially extending flange portions 230 and 232 that are positioned in abutting relation with each other. The flange 232 has a plurality of threaded apertures 234 for receiving bolts 236. The coupling half 222 has an arcuate slotted portion 238 illustrated in FIG. 7. The bolts 236 extend through the arcuate slots 238 into the threaded bores 234 to secure the coupling halves to each other. With this arrangement the feed roll actuator shaft 214 with the front stops mounted thereon may be rotated relative to the connecting shaft 226 to adjust the relative position of the front stops and the bolts 236 thereafter secure the coupling halves to each other.

The connecting shaft 226 is rotatably supported in a bore 240 of arm member 242. The arm member 242 is in turn, secured to the side wall of the press by means of bolts 224. With this arrangement connecting shaft 226 through coupling member 216 is arranged to oscillate the feed roll drive shaft 214. A pair of chains 246 and 248 are secured to the connecting shaft 226 by means of pins 250, as illustrated in FIG. 9. The pins 250 extend into receiving bores 252 in the connecting shaft 226. Bolts 254 retain the pins 250 in the bores 252.

The chain 246, as illustrated in FIG. 7, has its other end 256 secured to the arcuate surface 258 of the lever generally designated by the numeral 260. Thus the chain 246 is wrapped partially around the connecting shaft 226 in a clockwise direction as viewed in FIG. 7 and has one end connected to the connecting shaft 226 and the other end connected to the lever 260. The chain 248 is also partially wrapped around the connecting shaft 226 in a direction opposite to the chain 246 and has an end portion secured to the connecting shaft 226. The other end portion of chain 248 is connected to a shaft 262 that extends beyond the lever 260. The shaft 262 has nuts 264 secured to the end portion thereof and a spring member 266 abuts the bolts and a flange 268 on the lever member 260. With this arrangement the chain 248 is maintained under tension by means of the spring 266 and the amount of tension can be adjusted by means of bolts 264.

The lever 260 has a body portion 270 with the arcuate end surfce 258, previously described, and an annular end portion 272 with a bore 274 therein. An annular eccentric bushing 276 is positioned within the bore 274 and is mounted on a shaft 278 which may be an extension of the shaft for the transfer cylinder 280.

The lever 260 has a cam follower roller 282 rotatably mounted thereon between the arcuate edge 258 and the annular end portion 272. The cam follower 282 is arranged to ride on the surface of the cam 284 which is non-rotatably mounted on the shaft 286 associated with the pickup or transfer cylinder 288.

The lever body portion 270 has a depending portion 290 that has a shaft 292 pivotally connected thereto by pin 294. The shaft 292 extends downwardly therefrom into a tubular member 296 that is secured in a ring 298 that is secured to the press frame. A spring 300 extends around the shaft 292 and abuts the tubular member 296 and the lever depending portion 290. The tubular member 296 is movable axially within the ring 298 to increase and decrease the resilient force of spring 300 on lever 260.

The eccentric bushing 276 has an adjusting lever 302 secured thereto at one end and the other end is secured to an adjusting wheel 304 suitably mounted in the press frame. Rotation of adjusting wheel 304 moves the lever longitudinally which, in turn, rotates the eccentric bushing 276 relative to the shaft 278 and the annular end portion 272 of lever 260.

The adjustment of the eccentric bushing 276 within the bore 274 moves the pivot axis of the lever 260 in the direction indicated by the arrows and the letter A in FIG. 7. The substantially longitudinal adjustment of the lever body portion moves the cam follower 282 longitudinally therewith and the relative position of the cam follower to the cam 284 is changed so that the oscillation of the roll actuator shaft is advanced or retarded relative to the rotation of the shaft 286. The changing of the timing by the adjustment of the eccentric bushing 276 adjusts the amount of buckling of the sheet without changing the relative position of the front guide member on the feed roll shaft so that now the amount of buckling of the sheet can be adjusted accurately while the press is in operation. Further, an adjustment of the feed rolls at the feedboard is unnecessary with this arrangement.

In the above described embodiment both of the flexible members are secured to the shaft 226 and are positioned on the arcuate surface 258 of lever 260. The chains 246 and 248 are maintained in tension about the shaft 226 by the resilient spring 266. Rotation of the cam member 284 on shaft 286 through cam follower 282 oscillates the lever 260 to thus oscillate the feed rolls and propel the sheets toward the transfer cylinder. The spring 300 urges the lever in a counter-clockwise direction as viewed in FIG. 7 and urges the cam follower 282 into abutting relation with the surface of the cam 284.

Although the chains 246 and 248 are illustrated as two separate chains partially wrapped about shaft 226, it should be understood that a single chain or flexible element could be wrapped around the shaft 226 and secured thereto with the end portions secured to the lever arcuate portion 258 substantially as illustrated. Further, the spring 266 maintains the chains 246 and 248 in tension and is not subject to elongation so that the spring life is increased. Further, the positioning of the pair of chains on the arcuate surface of the lever 260 reduces substantially the structural and space requirements for the oscillating apparatus.

According to the provisions of the patent statutes, I have explained the principle, preferred construction and mode of operation of my invention and have illustrated and described what I now consider to represent its best embodiments. However, I desire to have it understood that, within the scope of the appended claims, the invention may be practiced otherwise than as specifically illustrated and described.

I claim:

1. Apparatus for feeding sheets to a sheet fed printing press comprising, a feedboard, a rotatable cylinder mounted adjacent to the delivery end of said feedboard, a feed roll drive shaft extending transversely across said feedboard adjacent to said feedboard delivery end, driven feed rolls secured to said feed roll drive shaft for rotation therewith, a cam member rotatable in timed relation with said rotatable cylinder, a lever member pivotally connected to a pivot shaft adjacent to said cam member, said lever member having a pivot axis and said lever member being movable by said cam member, flexible means connected to said feed roll drive shaft and to said lever member, said lever member being movable by said cam member to oscillate said feed roll drive shaft and said driven feed rolls through a preselected angular displacement in timed relation with said cylinder, and means to move said lever member pivot axis and rotate said feed roll drive shaft by said flexible means through a predetermined angular distance.

2. Apparatus for feeding sheets to a sheet fed printing press as set forth in claim 1 in which said flexible means includes, a flexible member having an end portion wrapped in a first direction around at least a portion of said feed roll drive shaft and the other end portion connected to said lever member, said lever member movable toward and away from said feed roll drive shaft by said cam member.

3. Apparatus for feeding sheets to a sheet fed printing press as set forth in claim 2 which includes, a second flexible member having an end portion wrapped in a direction opposite to said first direction around at least a portion of said feed roll drive shaft, resilient means connected to said second flexible member and maintaining said second flexible member under tension.

4. Apparatus for feeding sheets to a sheet fed printing press as set forth in claim 3 which includes, means to adjust the tension exerted by said resilient means on said second flexible member.

5. Apparatus for feeding sheets to a sheet fed printing press as set forth in claim 3 in which, said resilient means connected to said second flexible member has a portion connected to a frame portion of said printing press.

6. Apparatus for feeding sheets to a sheet fed printing press as set forth in claim 3 in which, said first flexible member has said other end portion secured to an arcuate end surface of said lever, said second flexible member having the other end portion connected to said arcuate end portion of said lever.

7. Apparatus for feeding sheets to a sheet fed printing press as set forth in claim 1 which includes, a cam follower mounted on said lever and arranged to abut the peripheral surface of said cam member, said flexible means including a flexible member connected to said lever and having an end portion wrapped around at least a portion of said feed roll drive shaft, said cam member arranged upon rotation to pivot said lever through a preselected angular distance and thereby through said flexible member rotate said feed roll drive shaft and rotate said drive rolls through a preselected angular distance, and means urging said cam follower against the peripheral surface of said cam member.

8. Apparatus for feeding sheets to a sheet fed printing press as set forth in claim 1 which includes, front guide members nonrotatably mounted on said feed roll drive shaft and extending radially therefrom, said front guide members operable to align the front edge of a sheet on said feedboard.

9. Apparatus for feeding sheets to a sheet fed printing press as set forth in claim 8 which includes, means to separately and selectively rotate said front guide members on said feed roll drive shaft.

10. Apparatus for feeding sheets to a sheet fed printing press as set forth in claim 8 which includes, means to rotate said front guides through a preselected angular displacement while said printing press is in operation.

11. Apparatus for feeding sheets to a sheet fed printing press comprising, a feedboard, a rotatable cylinder mounted adjacent to the delivery end of said feedboard, a feed roll drive shaft extending transversely across said feedboard adjacent to said feedboard delivery end, driven feed rolls secured to said feed roll drive shaft for rotation therewith, a cam member rotatable in timed relation with said rotatable cylinder, flexible means connected to said feed roll drive shaft and to a lever member, said lever member being movable by said cam member to oscillate said feed roll drive shaft and said driven feed rolls through a preselected angular displacement in timed relation with said cylinder, and an eccentric member, said lever member pivotally mounted on said eccentric member, and means to rotate said eccentric member to thereby move the pivot axis of said lever member and through said flexible member rotate said feed roll drive shaft through a predetermined angular distance and thereby adjust the amount of buckle imparted to a sheet by the feed rolls as the sheet is fed into the gripper portion of said rotatable cylinder.

12. Apparatus for feeding sheets to a sheet fed printing press as set forth in claim 11 which includes, an arm member extending radially from said eccentric member, an adjusting shaft connected to said arm member, means to move said adjusting shaft linearly to rotate said eccentric member and thereby change the pivot axis of said lever while said rolls are being driven by said cam member.

13. Apparatus for feeding sheets to a sheet fed printing press comprising, a feedboard, a rotatable cylinder mounted adjacent to the delivery end of said feedboard, a feed roll drive shaft extending transversely across said feedboard adjacent to said feedboard delivery end, driven feed rolls secured to said feed roll drive shaft for rotation therewith, a cam member rotatable in timed relation with said rotatable cylinder, flexible means connected to said feed roll drive shaft and to a lever member, said lever member being movable by said cam member to oscillate said feed roll drive shaft and said driven feed rolls through a preselected angular displacement in timed relation with said cylinder, and said lever member includes an end portion with a bore therethrough and a cam follower rotatably mounted thereon in spaced relation to said bore, an eccentric bushing positioned in said lever member bore, said eccentric bushing and said lever mounted on a shaft member, and means to rotate said eccentric bushing to thereby move the pivot axis of said lever toward and away from said feed roll drive shaft to move said cam follower relative to said cam member to thereby change the oscillation time of the feed roll drive shaft relative to said rotatable cylinder and thereby change the amount of buckle imparted to a sheet by the driven feed rolls as the sheet is fed into the gripper portion of said rotatable cylinder.

14. Apparatus for feeding sheets to a sheet fed printing press as set forth in claim 13 which includes, an arm member connected at one end to said eccentric bushing, means to move said arm member axially to rotate said eccentric bushing in said lever bore to thereby move the pivot axis of said lever while said feed rolls are being driven by said cam member.

15. Apparatus for feeding sheets to a sheet fed printing press comprising, a feedboard, a rotatable cylinder mounted adjacent to the delivery end of said feedboard, a feed roll drive shaft extending transversely across said feedboard adjacent to said feedboard delivery end, driven feed rolls secured to said feed roll drive shaft for rotation therewith, a cam member rotatable in timed relation with said rotatable cylinder, flexible means connected to said feed roll drive shaft and to a lever member, said lever member being movable by said cam member to oscillate said feed roll drive shaft and said driven feed rolls through a preselected angular displacement in timed relation with said cylinder, a connector member having an axial bore therethrough and an outer face portion, said feed roll drive shaft extending through said bore, a hub member nonrotatably connected to said shaft end portion, said flexible means connected to said connector member, said hub member connected to said connector member outer face so that said feed roll drive shaft rotates with said connector member, and adjustment means to rotate said feed roll drive shaft relative to said connector member to adjust the amount of buckle imparted to a sheet by said feed rolls as the sheet is fed into the gripper portion of said rotatable cylinder.

* * * * *